US007066140B2

(12) United States Patent
Emanuelsson et al.

(10) Patent No.: US 7,066,140 B2
(45) Date of Patent: Jun. 27, 2006

(54) CRANKCASE SCAVENGED FOUR-STROKE ENGINE

(75) Inventors: Lennart Emanuelsson, Huskvarna (SE); Peter Gunnarsson, Gränna (SE); Esbjörn Ollas, Huskvarna (SE); Tore Aronsson, Mölndal (SE)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 10/501,804

(22) PCT Filed: Jan. 30, 2003

(86) PCT No.: PCT/SE03/00165

§ 371 (c)(1),
(2), (4) Date: Nov. 1, 2004

(87) PCT Pub. No.: WO03/064826

PCT Pub. Date: Aug. 7, 2003

(65) Prior Publication Data

US 2005/0145215 A1 Jul. 7, 2005

(30) Foreign Application Priority Data

Jan. 30, 2002 (WO) ..... PCT/SE02/00175

(51) Int. Cl.
*F02B 75/02* (2006.01)

(52) U.S. Cl. ..... 123/317; 123/55.4; 123/78; 123/572

(58) Field of Classification Search ..... 123/317, 123/55.4, 76, 572
See application file for complete search history.

(56) References Cited

U.S. PATENT DOCUMENTS 5,347,967 A 9/1994 Todero et al.
6,145,484 A 11/2000 Funakoshi et al.
6,167,874 B1 * 1/2001 Becker et al. ..... 123/572

* cited by examiner

*Primary Examiner*—Tony M. Argenbright
*Assistant Examiner*—Katrina B. Harris
(74) *Attorney, Agent, or Firm*—Pearne & Gordon LLP

(57) ABSTRACT

A crankcase scavenged and lubricated four-stroke engine (1) comprising especially: a mixture-preparation device (15) for supplying an air-fuel-lubricant mixture; an intake channel (16) connecting to the crankcase or cylinder to supply at least air (13) to the crankcase volume (12); an overflow channel (17) connecting to the crankcase or cylinder and to the intake opening (7) with intake valve (8) to supply to the intake at least air and lubricant from the crankcase volume; a valve drive assembly (18) driven by a crankshaft (4) for actuating the intake valve (8) and the exhaust valve (10); a valve drive assembly housing (19, 20, 21, 21', 22) comprising one or more sections (19, 20, 21, 21', 22) which is/are separate from the crankcase but in communication exclusively with the crankcase volume via at least one small size passage (23, 24, 25, 26, 27), and each section (19, 20, 21, 21', 22) of the valve drive assembly housing has a lowest part situated closer to the combustion chamber, than the lowest part of the crankcase.

22 Claims, 7 Drawing Sheets

CRANKCASE SCAVENGED FOUR-STROKE ENGINE

This application claims the benefit of International Application Number PCT/SE03/00165, which was published in English on Jan. 30, 2003.

TECHNICAL FIELD

The subject invention refers to a crankcase scavenged four-stroke engine according to the preamble of claim 1. It is primarily intended for a portable tool such as a chain saw, a trimmer or a power cutter.

BACKGROUND OF THE INVENTION

Portable tools such as chain saws or power cutters are used in many different handling positions, even upside down. They are therefore usually crankcase scavenged and lubricant, e.g. oil is supplied to the crankcase. This lubrication system works in every handling position. These engines are usually of two-stroke type, but also four-stroke engines have been suggested.

U.S. Pat. Nos. 4,708,107, 5,347,967, 5,579,735 and 6,145,484 and DE 30 22 901 show crankcase scavenged oil in fuel engines. A flow is arranged via the valve drive assembly housing into the combustion chamber via the intake valve. This system provides good lubrication but gives a strong heating of the intake air being in contact with very hot engine parts. This reduces the power output. This applies also for a part flow in U.S. Pat. No. 6,401,701 and DE 34 38 031. However, this requires a very complex structure of the intake system.

There are also designs that are not crankcase scavenged and lubricated. In these designs an oil sump or tank is filled with oil to a recommended oil level. Therefore there is no need to supply oil to the fuel. But instead they need an oil tank or oil sump of considerable size. This tank or sump usually reaches well below the level of the crankcase. Therefore the size and the weight of the engine is increased considerably. Examples are EP 1 134 365 and EP 1 136 665. They also use special extra parts for creating oil mist.

U.S. Pat. No. 6,152,098 shows a design with an oil sump of considerable size reaching down well below the crankcase. It is to be filled with oil to a prescribed level. Weight and size is somewhat reduced compared to the EP application-designs above, but is still a problem. The engine is crankcase scavenged using pure fuel, i.e. not mixed with oil.

U.S. Pat. No. 6,145,484 shows some versions that are not crankcase scavenged but have ducts leading from the intake duct both to the crankcase and to the valve drive assembly in a complex manner.

PURPOSE OF THE INVENTION

The purpose of the subject invention is to substantially reduce the above outlined problems and to achieve advantages in many respects.

SUMMARY OF THE INVENTION

The above-mentioned purpose is achieved in a crankcase scavenged four-stroke engine in accordance with the invention having the characteristics appearing from the appended claims. The crankcase scavenged engine in accordance with the invention is thus essentially characterized in that it further comprises: a valve drive assembly housing comprising one or more sections which is/are separate from the crankcase volume but in communication exclusively with the crankcase volume through at least one small size passage, and each section of the valve drive assembly housing has a lowest part situated higher in the axial direction of the cylinder bore, i.e. closer to the combustion chamber, than the lowest part of the crankcase. This means that there is no flow through the valve drive assembly housing into the combustion chamber. Therefore the intake air is essentially not heated by very hot parts of the engine. This increases power output. The small size passage has a limited impact on the capacity of the crankcase pumping. As there is no oil sump or oil tank the engine will be more compact and weigh less and the lowest part of the valve drive assembly housing is situated higher than the crankcase. The small size of the valve drive assembly housing means that it will collect only small amounts of oil during normal operation of the engine.

In one embodiment there is only a single small size passage free from valves, but there can also be more passages and they can also be provided with different kind of valves.

Further characteristics and advantages of the invention will be apparent from the description of preferred embodiments. The embodiments can be combined.

BRIEF DESCRIPTION OF THE DRAWINGS

The invention will be described in closer detail in the following by way of various embodiment thereof, with reference to the accompanying drawing figures in which the same numbers in the different figures state one another's corresponding parts. For convenience up and down in the engine refers to up and down in the drawing figures. The engine can be arranged in various positions in different products and these products can be used in different positions.

DESCRIPTION OF PREFERRED EMBODIMENTS

Figure 1:
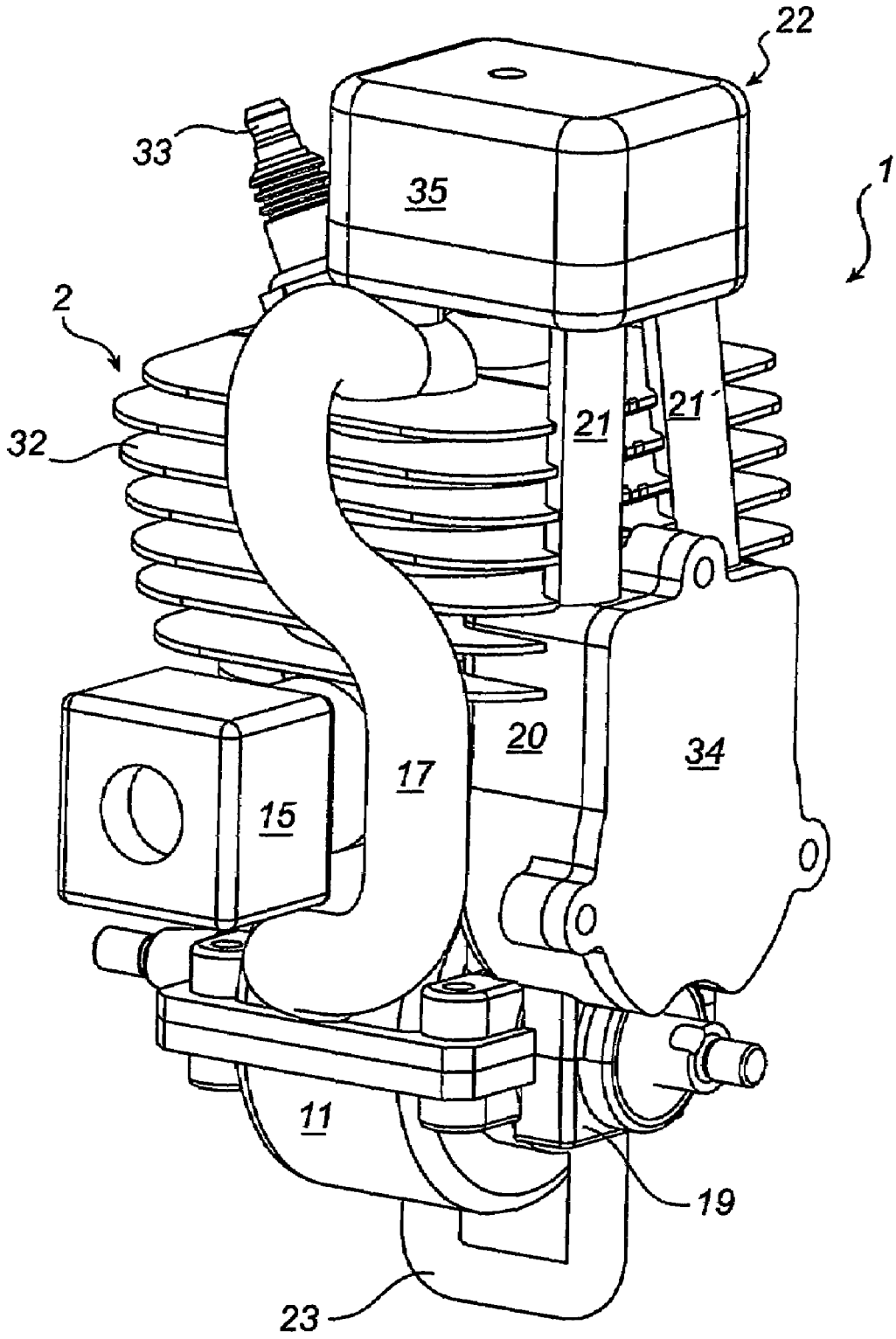
FIG. 1 is a perspective view of a four-stroke engine according to the invention. It shows the main parts of the engine and especially the valve drive assembly housing and its different sections.

FIG. 1 shows a crankcase scavenged four-stroke engine 1 according to the invention as seen in a perspective view. The engine has a cylinder 2 with cooling fins 32 and a spark plug 33. A crankcase 11 is connected below the cylinder 2. An overflow channel 17 connects to the crankcase or the cylinder and to the intake opening with intake valve. A mixture preparation device 15 for supplying an air-fuel-lubricant mixture is connected to the cylinder. A valve drive assembly 18 is enclosed in a valve drive assembly housing 19, 20, 21, 21', 22.

A small size passage 23 is connected between the crankcase 11 and the lowest section 19 of the valve drive assembly housing. The second lowest section of the valve drive assembly housing 20 is covered by a lid 34. The top section 22 of the assembly housing is connected to the lower sections 20, 19 through tubes 21, 21', and is covered by a lid 35.

Figure 2:
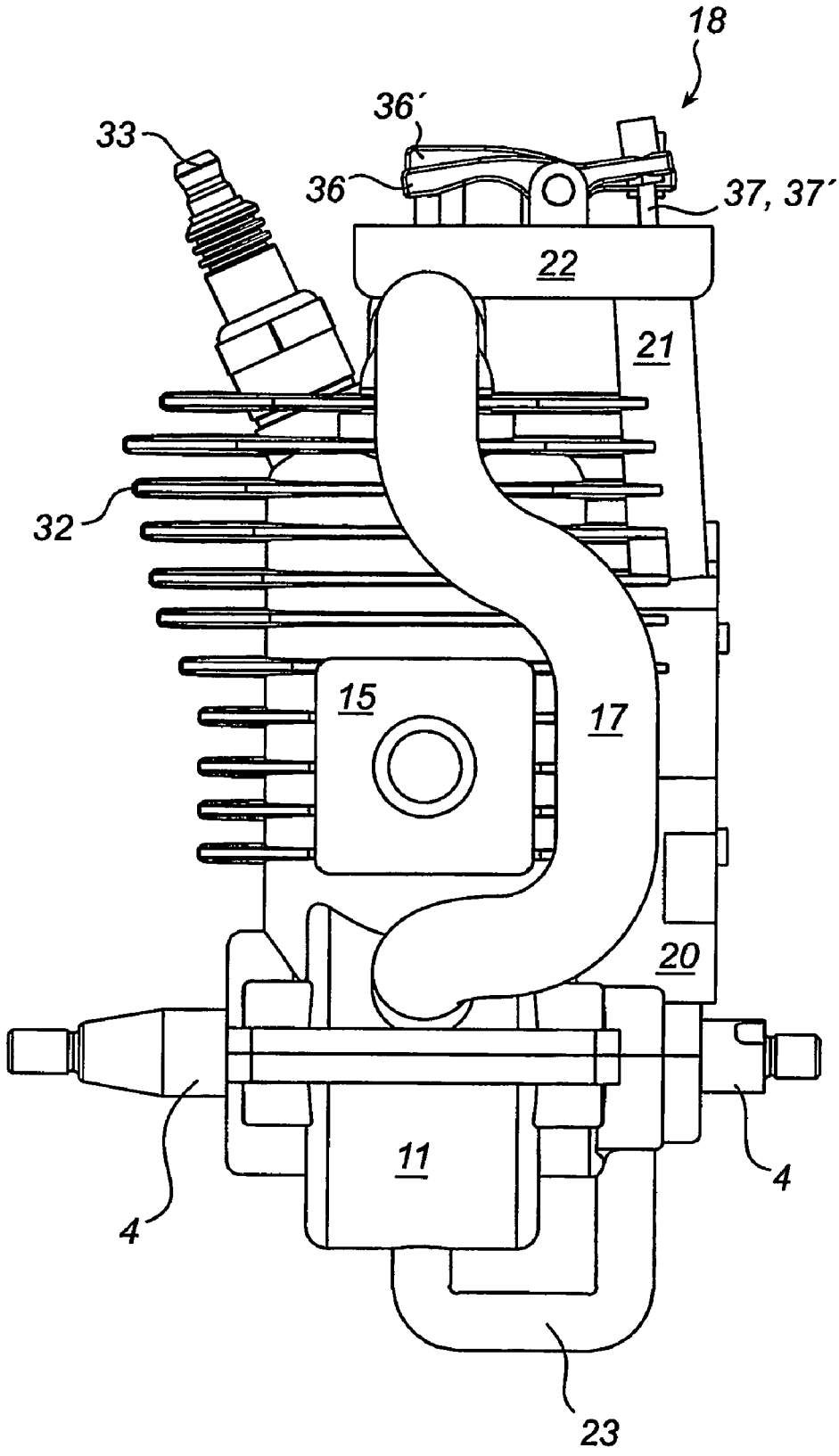
FIG. 2 is a side view of the engine according to FIG. 1. Two lids have been lifted off.

FIG. 2 shows a view from the side of the engine according to FIG. 1. The lid 34 has been removed. Also the lid 35 of the top section 22 has been removed. A part of the valve drive assembly 18 is thereby shown. Two rocker arms 36, 36' are shown as well as two push rods 37, 37'. A crankshaft 4 is also visible in both ends protruding out of the crankcase 11.

Figures 3A, 3B:
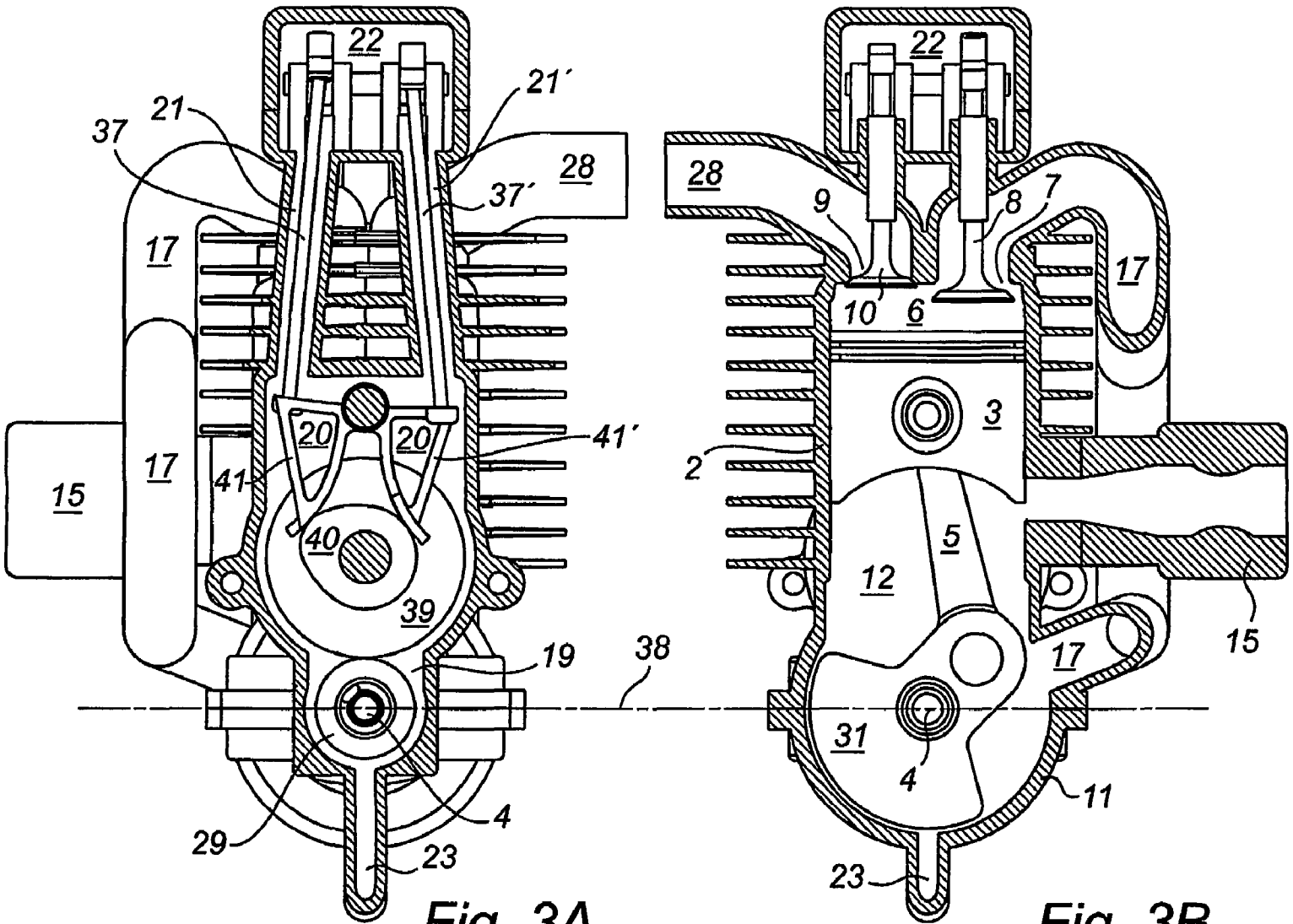
FIGS. 3A and 3B show two important cross-section views of the engine side by side. The crankcase volume and the valve drive assembly housing and its different sections with the valve drive assembly appears clearly.

In FIGS. 3*a* and 3*b* the two most important sections of the engine are shown. The two sections are shown side by side and the crankshaft 4 is lying on the axis 38. FIG. 3*b* shows the engine cylinder 2 with a piston 3 movably mounted in the cylinder in order to rotatingly drive the crankshaft 4 via a connecting rod 5. The cylinder and the piston conjointly delimit a combustion chamber 6. The cylinder having an intake opening 7 and an intake valve 8 for opening and closing the intake opening. The cylinder has an exhaust opening 9 and an exhaust valve 10 for opening and closing the exhaust opening, followed by an exhaust duct 28. The overflow channel 17, connecting the crankcase or cylinder and the intake opening 7, is clearly shown as the mixture preparation device 15. It supplies an air-fuel-lubricant mixture to a crankcase volume 12. It could also supply air and lubricant to the crankcase volume 12. In this case fuel is supplied to the overflow channel 17 and mixed with air or maybe directly into the combustion chamber 6. A two stage apparatus is thus possible. The crankshaft 4 has a crank mechanism 31, 31' connecting the crankshaft with a connecting rod 5. A small size passage 23 connects the crankcase volume 12 with the valve drive assembly housing 19, 20, 21, 21', 22. This housing is shown clearly in FIG. 3A. The small size passage 23 coming from the crankcase 11 arrives at the lowest section 19 of the valve drive assembly housing. The next section or middle section 20 is connected to the top section 22 via the tubes 21, 21'.

A crankshaft gear wheel 29 is arranged on the crankshaft in the lowest section 19 of the valve drive assembly housing. This section has an approximate radius that is considerably smaller than the corresponding radius of the crankcase and can therefore not form an oil sump. A cooperating gear wheel 39 is supplied with a fixed cam 40. Two cam followers 41, 41' ride on this cam. They each have a push rod 37, 37' that drives the valves 8, 10 via the rocker arms 36, 36'. This is conventional and is therefore not further described.

However, a small size connection between the crankcase volume 12 and the valve drive assembly housing 19, 20, 21, 21', 22 is special. The valve drive assembly housing comprises one or more sections 19, 20, 21', 21', 22, which is/are separate from the crankcase volume but in communication exclusively with the crankcase volume through the small size passage 23. As can be clearly seen each section 19, 20, 21, 21', 22 of the valve drive assembly housing has a lowest part situated higher in the axial direction of the cylinder bore, i.e. closer to the combustion chamber than the lowest part of the crankcase. They can therefore not form an oil sump when the engine is operated in normal positions.

Figure 4A:
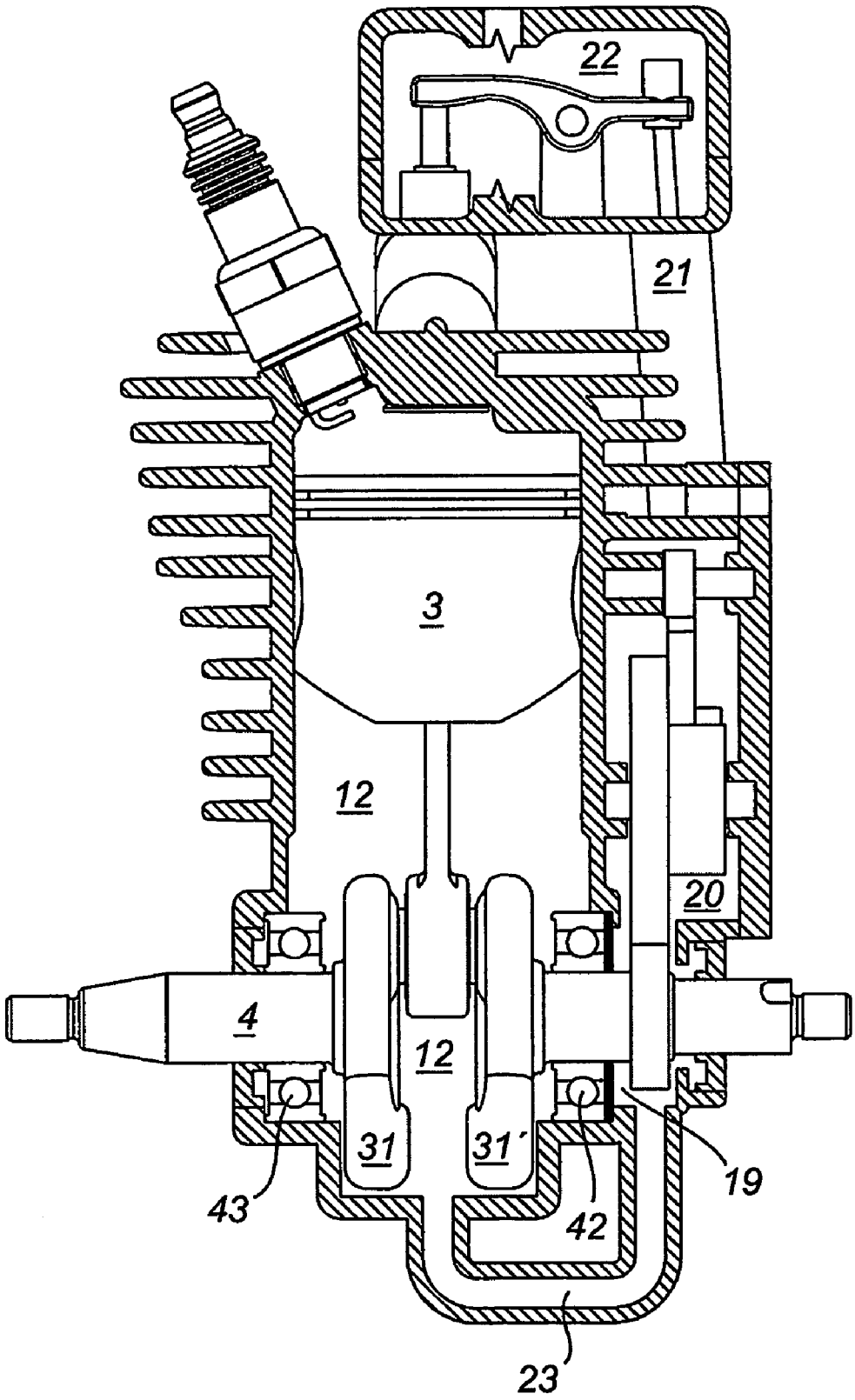
FIG. 4A shows a cross-section view of the engine and a small size passage connecting a crankcase volume and the valve drive assembly housing.

FIG. 4A shows one embodiment of a small size passage 23. The passage is arranged as a duct leading from the crankcase 11 to the lowest section 19 of the valve drive assembly housing. The passage 23 is free from valves and there is only a single small size passage free from valves. The small size passage 23 has an area smaller than the cross-section area of an aperture with a diameter of 40% of the cylinder diameter and preferably smaller than 30% of the cylinder diameter. For lubrication purposes it could be preferable to have a very small cross-section area smaller than the cross-section of an aperture with a diameter of 20% of the cylinder diameter and preferably 10% of the cylinder diameter. But there can also be more than one passage. In this case the total cross-section area should be smaller than the cross-section area of the mentioned sizes. One or more passages can be arranged in many ways. As shown in FIG. 4A the right bearing 42, i.e. a bearing on the right side of the crank mechanism 31, 31', is sealed. Therefore it will not leak between the crankcase volume 12 and the valve drive assembly housing. The left bearing 43 is not sealed. If that kind of bearing would be used on the right side it would give considerable leakage between the volumes. But it could also be partly sealed to form a small size passage of suitable area.

Figure 4B:
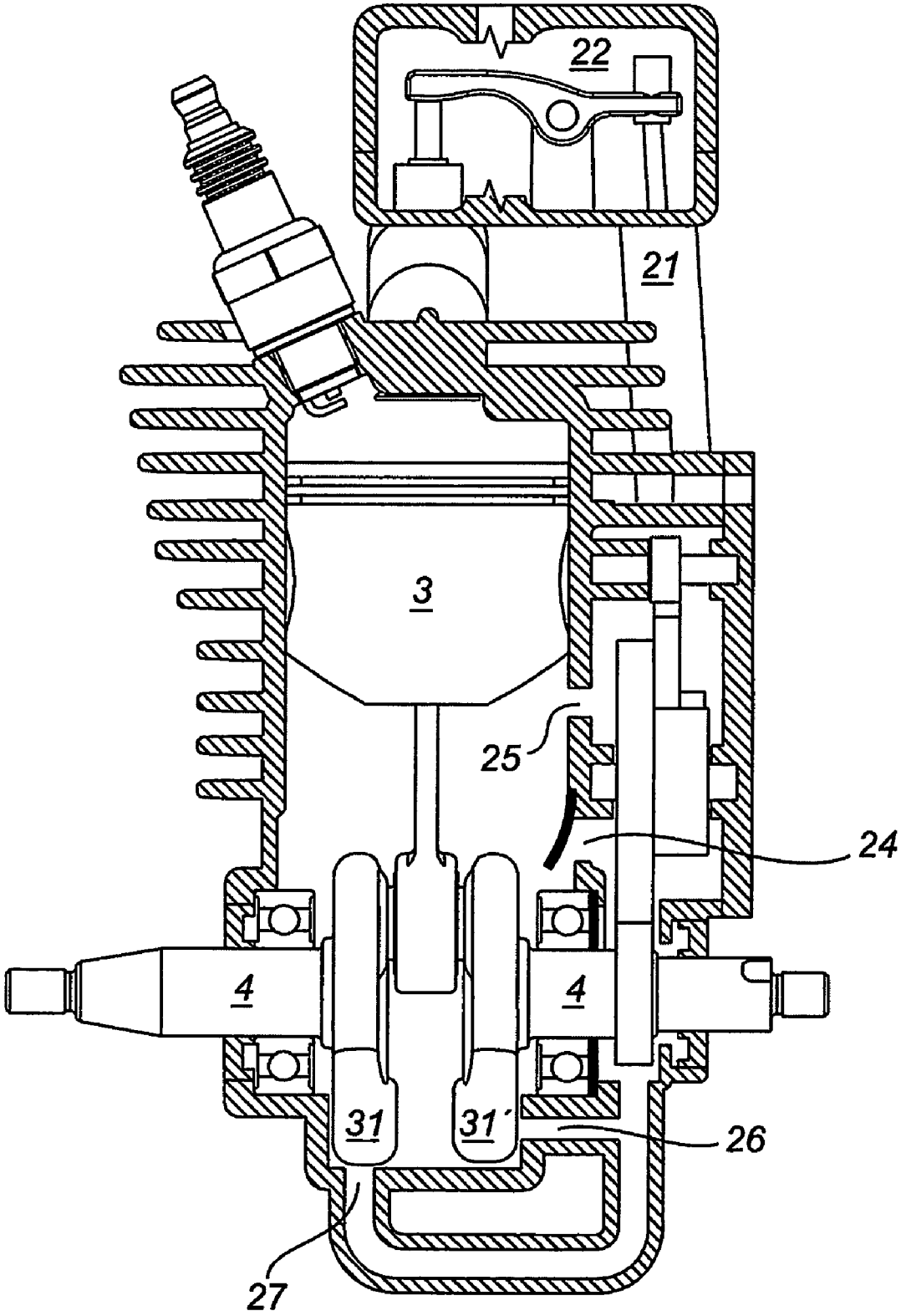
FIG. 4B shows a number of different small size passages controlled by valves.

FIG. 4B shows a number of different passages that use valves and are therefore opened and closed. The passage 24 connecting the crankcase volume and the lubricating place constituted by the valve drive assembly housing, 19, 20, 21, 21', 22 is provided with a check valve. This check valve can be arranged to allow flow only into the valve drive assembly housing. It can also be arranged to allow flow only from the valve drive assembly housing. Usually it is in either case combined with another small size passage that is either free from valve or controlled by a valve. This also applies for the passages 25, 26 and 27. The passage 25 is controlled by the piston 3, so that it is opened and shut by the piston during every stroke of the piston. The passage 26 is controlled by an axial surface of the crank mechanism 31'. By comparison with FIG. 3B it is evident that the passage 26 will be opened and shut during every revolution of the crankshaft. The crank mechanism therefore forms a rotary valve opening and shutting with possibly down to half the frequency of the opening and shutting provided by the piston for passage 25. The rotary valve control can therefore provide more possibilities for the control. Another example of a rotary valve controlled passage is passage 27, which is controlled by the peripheral outer radius of crank mechanism 31.

Figure 5:
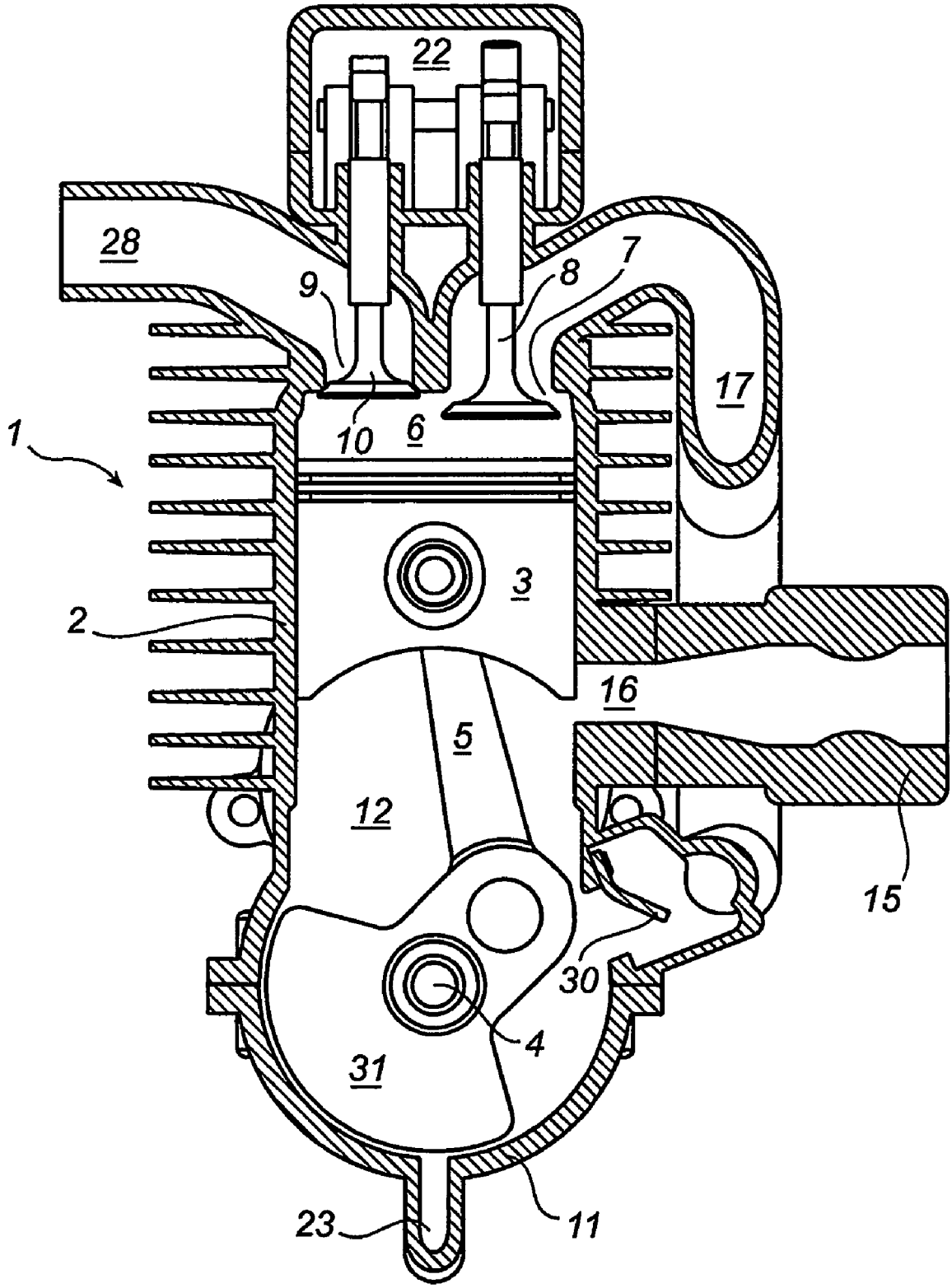
FIG. 5 shows a cross-section view of the engine as seen along the crankshaft.

As evident from FIG. 5 the overflow channel 17 is provided with a check valve 30 to allow flow only from the crankcase. This will provide a pressure charging of the engine increasing its power. The check valve 30 can also be substituted by a piston ported valve or by a rotary valve in the same way as shown for passage s 25 and 26, 27 in FIG. 4B. Thereby an unrestricted flow can be achieved in the overflow channel 17. As seen the intake channel 16 is controlled by the piston 3, i.e. a piston ported design. It could however also be controlled by a check valve or by a rotary valve. In case both the overflow channel 17 and the intake channel 16 are controlled by a rotary valve it could be possible to increase the power of the engine. This is arranged through a special timing of all the three valves for the intake channel 16, the overflow channel 17 and the intake valve 8. If a so called overlap is arranged, i.e. all three valves are open at the same time the momentum of a flowing gas in the overflow channel 17 can be used to increase the charge into the combustion chamber 6. This will increase the power of the engine. Two different rotary valve arrangements have been shown. But the rotary valve can also be constituted by parts driven by the cam shaft or driven at the same speed as the cam shaft, i.e. half the speed of the crankshaft. This can provide special tuning possibilities.

The engine described in FIG. 1–6 uses a push rod arrangement for the valve control. It is a so called OHV-engine. But the principles described for lubricating the valve drive assembly housing 19, 20, 21, 21', 22 can also be used for other types of valve drive assemblies. Instead of gear wheels 29 and 39 two corresponding chain sprockets could be used connected with a chain. The higher sprocket would be supplied with a cam 40. In this way the cam 40 could be located higher up in the engine to shorten the push rods 37, 37' or to eliminate them. It is also possible to use gear wheels located between gear wheels 29 and 39 to accomplish the same result. The engine could also be of a so called side valve type. The cam followers 41, 41' could in this case control the valves directly.

Figure 6:
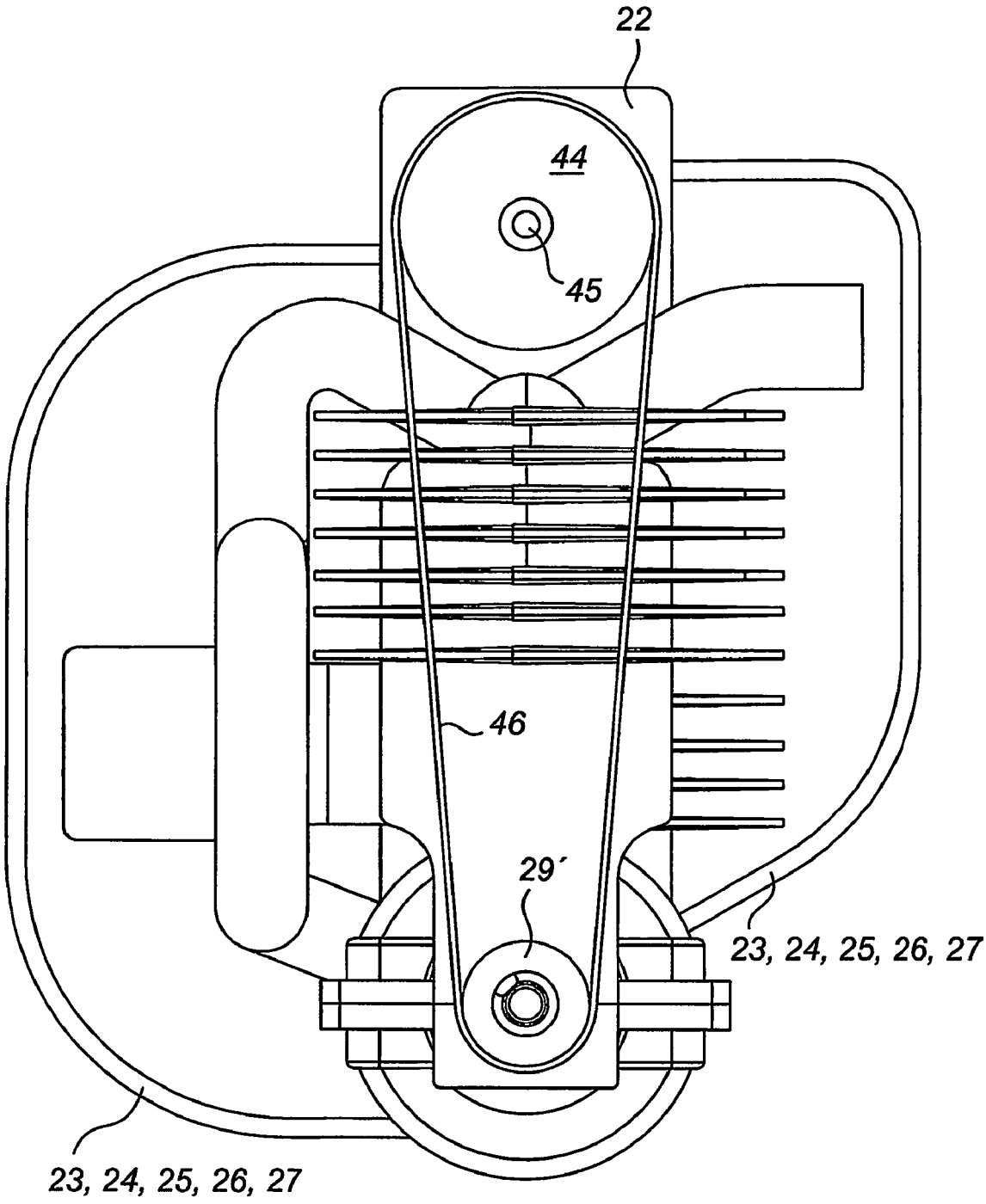
FIG. 6 shows an alternative embodiment of a four-stroke engine having an overhead cam shaft.

FIG. 6 shows an engine with a cam shaft 45 located above the valves and controlling them, either directly or via rocker arms. This is a so called OHC-engine. It uses a pulley 29' and a pulley 44 connected by a toothed belt 46. This is a conventional design and is therefore not further described. As the belt should not be lubricated it is possible to use a valve drive assembly housing comprising only a top section 22. This housing section 22 is in communication with the crankcase volume through at least one small size passage. Many alternatives are possible. There could be only one passage 23 free of valves. This passage can be supplemented by another passage using a check valve 24 or a piston ported valve 25 or a rotary valve 26 or 27 as described in FIG. 4*b*. Different combinations including two passages free of valves 23 are possible as well as different combinations of passages using a valve. Using a passage with a valve can increase the flow of air and lubricant to the top section 22.

The invention claimed is:

1. A crankcase scavenged and lubricated four-strok engine (1) comprising:

a cylinder (2)

a piston (3) movably mounted in the cylinder in order to rotatingly drive a crankshaft (4) via a connection rod (5);

the cylinder and the piston conjointly delimiting a combustion chamber (6);

the cylinder having an intake opening (7) and an intake valve (8) for opening and closing the intake opening;

the cylinder having an exhaust opening (9) and an exhaust valve (10) for opening and closing the exhaust opening, followed by an exhaust duct (28);

a mixture-preparation device (15) for supplying an air/fuel-lubricant mixture or for supplying in two steps an air/lubricant mixture and an air/fuel mixture;

a crankcase (11) connected to the cylinder and delimiting together with the underside of the piston (3) a crankcase volume (12), to which at least air (13) and lubricant (14) is supplied by the mixture preparation device;

an intake channel (16) connecting to the crankcase or cylinder to supply at least air (13) to the crankcase volume (12);

an overflow channel (17) connecting to the crankcase or cylinder and to the intake opening (7) with intake valve (8) to supply the intake at least air and lubricant from the crankcase volume;

a valve drive assembly (18) driven by said crankshaft (4) for actuating the intake valve (8) and the exhaust valve (10), characterized in that it further comprises:

a valve drive assembly housing (19, 20, 21, 21', 22) comprising one or more sections (19, 20, 21, 21', 22) which is/are separate from the crankcase volume but in communication exclusively with the crankcase volume through at least one small size passage (23, 24, 25, 26, 27), and each section (19, 20, 21, 21', 22) of the valve drive assembly housing has a lowest part situated higher in the axial direction of the cylinder bore, than the lowest part of the crankcase.

2. A four-stroke engine according to claim 1, wherein the valve drive assembly has a crankshaft gear wheel (29) or a chain sprocket arranged on the crankshaft and the lowest section (19) of the vavle drive assembly housing that surrounds this gear wheel has an approximate radius that is considerably smaller than the corresponding radius of the crankcase and can therefore not form an oil sump.

3. A four-stroke engine according to claim 1, wherein the at least one small size passage (23) is free from valves.

4. A four-stroke engine according to claim 3, wherein there is only a single small size passage (23) free from valves.

5. A four-stroke engine according to claim 1, 2 or 3, wherein the at least one small size passage (24) or duct connecting the crankcase volume and the lubricating place constituted by the valve drive assembly housing (19, 20, 21, 21', 22) is provided with a check valve.

6. A four-stroke engine according to claim 5, wherein the check valve is arranged to follow only into the valve drive assembly housing.

7. A four-stroke engine according to claim 5, wherein the check valve is arranged to allow flow only from the valve drive assembly housing.

8. A four-stroke engine according to claim 1, wherein the at least one passage (25) is opened and shut by the piston (3).

9. A four-stroke engine according to claim 1, wherein the at lest one passage (26, 27) is controlled by a rotary valve.

10. A four-stroke engine according to claim 1 wherein at least one small size passage (23, 24, 25, 26, 27) has a combined cross-section area smaller than the cross-section area of an aperture with a diameter of 40% of the cylinder diameter.

11. A four-stroke engine according to claim 1, wherein the at least one small size passage (23, 24, 25, 26, 27) has a combined cross-section area smaller than the cross-section area of an aperture with a diameter of 20% of the cylinder diameter.

12. A four-stroke engine according claim 1, wherein the mixture preparation device is in the form of a carburettor or low pressure injection system providing an air-fuel-lubricant mixture to the crankcase volume.

13. A four-stroke engine according to claim 1, wherein the mixture preparation device is in the form of a two step apparatus, the first step mixing lubricant from a tank with air in the intake duct or in the crankcase volume and the second step mixing fuel and air in the over-flow channel (7).

14. A four-stroke engine according to claim 1, wherein the overflow channel (17) is supplied with a check valve (30) to allow flow only from the crankcase.

15. A four-stroke engine according to claim 1, wherein the overflow channel (17) is controlled by a rotary valve.

16. A four-stroke engine according to claim 15, wherein both the overflow channel (17) and the intake channel (16) is controlled by a rotary valve.

17. A four-stroke engine according to claim 15, wherein both the overflow channel (17) and the intake channel (16) is controlled by a rotary valve.

18. A four-stroke engine according to claim 9, wherein the rotary valve is constituted by the crank mechanism (31, 31').

19. A four-stroke engine according to claim 9, wherein the rotary valve is constituted by parts driven by the cam shaft or driven at the same speed as the cam shaft.

20. A four-stroke engine according to claim 1, wherein the at least one small size passage (23, 24, 25, 26, 27) is not in communication with the combustion chamber (16).

21. A four-stroke engine according to claim 1, wherein the at least one small size passage (23, 24, 25, 26, 27) is not in communication with the combustion chamber (6).

22. A four-stroke engine according to claim 1, wherein the valve drive assembly housing (19, 20, 21, 21', 22) is not in communication with the intake opening (17).

* * * * *